United States Patent [19]

Piesik

[11] 4,186,647

[45] Feb. 5, 1980

[54] MULTIPLE AREA REAR LAUNCH TUBE COVER

[75] Inventor: Edward T. Piesik, Pomona, Calif.

[73] Assignee: General Dynamics Corporation, Pomona Division, Pomona, Calif.

[21] Appl. No.: 932,245

[22] Filed: Aug. 9, 1978

[51] Int. Cl.[2] ..... F14F 3/04

[52] U.S. Cl. ..... 89/1.8; 89/1.816

[58] Field of Search ..... 89/1.8, 1.816, 1.817, 89/1.812; 239/265.15

[56] References Cited

U.S. PATENT DOCUMENTS

| | | | |
|---|---|---|---|
| 2,445,423 | 7/1948 | Eastman | 89/1.8 |
| 3,079,752 | 3/1963 | Thielman | 60/35.6 |
| 3,237,402 | 3/1966 | Steverding | 60/35.6 |
| 3,309,874 | 3/1967 | Gould | 60/253 |
| 3,499,364 | 3/1970 | D'Ooge | 89/1.817 X |
| 3,897,962 | 8/1975 | Sack | 239/265.15 X |
| 3,968,646 | 7/1976 | Betts et al. | 239/265.15 X |
| 4,044,648 | 8/1977 | Piesik | 89/1.8 |
| 4,134,327 | 1/1979 | Piesik | 89/1.8 |

*Primary Examiner*—David H. Brown

*Attorney, Agent, or Firm*—Henry M. Bissell; Edward B. Johnson

[57] ABSTRACT

A rear cover for a rocket launch tube which is normally closed and which is capable of breaking away successively in one or more sections in response to the pressure and diameter of the rocket exhaust column or plume. The cover is so arranged that it will successively increase the area interconnecting the launch tube for the rocket with an exhaust duct or manifold as the rocket plume increases in diameter. The cover of an adjacent launch tube which is normally closed will prevent the exhaust gases from entering the launch tube of a stored rocket or the like.

8 Claims, 6 Drawing Figures

MULTIPLE AREA REAR LAUNCH TUBE COVER

BACKGROUND OF THE INVENTION

1. Field of the Invention

This invention relates generally to controlled flow exhaust manifold systems, and more particularly relates to apparatus for normally sealing a launch tube for rockets or the like from an exhaust duct, and for opening the launch tube in response to gas pressure.

2. Description of the Prior Art

For military applications, rockets, missiles or other exhaust-gas-propelled vehicles are often stored in closely adjacent magazine chambers or launch tubes. In that case, exhaust gas ducts are normally provided to convey rocket exhaust gases generated during rocket ignitions to a safe location. Where available space is at a premium, for example, on ship-board, manifolding of a number of closely adjacent launch tubes or chambers into a common exhaust manifold or plenum chamber is often necessary.

Obvious problems exist if ducts connecting the launch tubes to the common exhaust manifold are normally open, that is, before launch of the vehicles. When one or more of the rockets is intentionally or accidentally ignited, portions of the resulting exhaust gases, which may have a temperature of about 6,000° F., will be circulated through the common manifold and into other launch chambers through the open, connecting ducts. Rockets and rocket warheads in these launch chambers are likely to be ignited or detonated by these hot exhaust gases. At the very least, the hot gases may damage the rockets or associated equipments, such as hold-down devices. Also, if the other launch chambers are open at the upper ends, which is the case of some launch tubes, exhaust gases entering the chambers through connecting ducts escape through the open, outer ends. This in turn may cause extensive heat damage to adjacent installations.

To prevent such occurrences, various types of safety doors or gas valves have been proposed in the past. These are normally installed, either at the outlet opening of each launch chamber or in the connecting duct to the exhaust manifold. When a rocket is accidentally or intentionally ignited, the associated safety door or valve is caused to open, which is usually in response to the exhaust gas. This will admit the exhaust gases into the manifold or exhaust duct. Doors and valves associated with other launch tubes are maintained closed to prevent circulation of the exhaust gases therethrough.

Such doors or valves have been disclosed, for example, in the U.S. Pat. No. to Eastman, 2,445,423, which discloses a safety container for rockets. The patent discloses hold-down doors for each launch tube which consist of a one-way, two-flap check valve. Springs are provided to hold the flaps closed. The rocket blast of an ignited rocket will blow open the check valve.

Another rocket exhaust control apparatus has been disclosed in the applicant's prior U.S. Pat. No. 4,044,648, assigned to the assignee of the present application. This patent discloses flow-control doors which are hinged and provided with counter-weights so that they are normally closed and can open under the pressure of an ignited rocket. The increased pressure in the exhaust duct will maintain the doors closed of other launch chambers of unignited rockets.

Another type of rear door for a rocket launch tube is disclosed in the applicant's copending application Ser. No. 860,039, now U.S. Pat. No. 4,134,327 filed on Dec. 12, 1977, and also assigned to the assignee of the present application. The door is latched open and normally remains open until the rocket is launched. A protective seal or frangible cover may normally close the launch tube until the missile is fired. The door may be released by a sensor as a missile leaves the launch tube. Gases from the launched rocket power the door closed. Subsequently, a latch locks the door in place, thereby to seal off the launch tube from the associated plenum chamber.

The U.S. Pat. No. to Sack, 3,897,962, relates to the nozzle of a gas generator. It is designed to provide a constant gas volume independent of thermodynamic conditions outside the generator. To this end, there is provided an opening in the center of the nozzle, and means to enlarge the opening in response to higher ambient temperatures. Hence, the nozzle is intended for regulating the gas flow, and to hold it at a constant pressure. It is not applicable to a rocket launch tube cover.

Other patents disclose variable thrust nozzles. Among these, for example, is a U.S. Pat. No. to Thielman, 3,079,752. It discloses a variable expansion ratio nozzle intended to increase the efficiency of a nozzle under variable pressures, and to provide more thrust in the upper atmosphere. To this end, a plurality of concentric inner nozzle exit portions are removably secured to an outer nozzle exit portion, thereby to provide variable gas expansion ratios.

Similarly, the U.S. Pat. No. to Steverding, 3,237,402, also relates to a variable thrust nozzle which is enlargeable. It provides optimum thrust in and out of the atmosphere. The exit area of the nozzle is controlled by removable ring-shaped ramps to be ejected at predetermined times. This may, for example, be accomplished by explosive bolts. The U.S. Pat. No. to Gould, 3,309,874, relates to an ablative nozzle which also changes its shape or area. Hence, during flight of the rocket, the nozzle is vaporized or eroded away so that the throat area increases.

Reference is also made to the U.S. Pat. Nos. to Betts et al., 3,968,646, 4,033,121 and 4,036,013. The patents disclose a rocket motor nozzle closure for controlling the release of pressure. The nozzle is arranged to open incrementally or continuously. As a result, the motor pressure is controlled by the rate of change of momentum of the nozzle closure.

SUMMARY OF THE INVENTION

In accordance with the present invention, apparatus is disclosed for closing one end of a launch tube for exhaust propelled vehicles, such as rockets or missiles. The apparatus is designed for opening the end of a launch tube in response to the exhaust plume.

Instead of providing rear doors, suggested by the prior art, in accordance with the present invention, the launch tube for a rocket or the like is closed at its lower end by a frangible cover. The cover is designed to break in response to the exhaust plume of a rocket which has been launched, whether intentionally or not. As a rocket leaves the launch tube, its exhaust plume increases in diameter at the rear of the launch tube. This increased exhaust plume or column preferably causes additional portions of the cover to break away.

In this manner, the connection between the launch tube and the duct or plenum chamber for conducting away the exhaust of the vehicle becomes increasingly larger. This in turn permits the exhaust gases to find a larger and larger exit opening, thereby to ensure that the exhaust gases flow into the exhaust duct. This will also maintain the pressure in the launch tube substantially constant at or below atmospheric pressure.

Preferably, the cover has a central, substantially circular section, and a plurality of substantially annular, concentric sections. These sections are arranged to break away successively in the manner previously explained.

Such a rear launch tube cover is considerably simpler in design and less expensive than the various doors suggested by the prior art. Due to its simplicity, there is less opportunity for the launch tube covering apparatus to become inoperative due to mechanical failures and the like.

On the other hand, once the frangible cover of the invention has been broken, the connection between the exhaust manifold and the launch tube remains open. In case this should present a problem, the type of door disclosed in the applicant's prior application Ser. No. 860,039, above referred to, may conveniently be used in addition to the frangible cover of the present invention.

The novel features that are considered characteristic of this invention are set forth with particularity in the appended claims. The invention itself, however, both as to its organization and method of operation, as well as additional objects and advantages thereof, will best be understood from the following description when read in connection with the accompanying drawing.

DESCRIPTION OF THE PREFERRED EMBODIMENT

Figure 1:
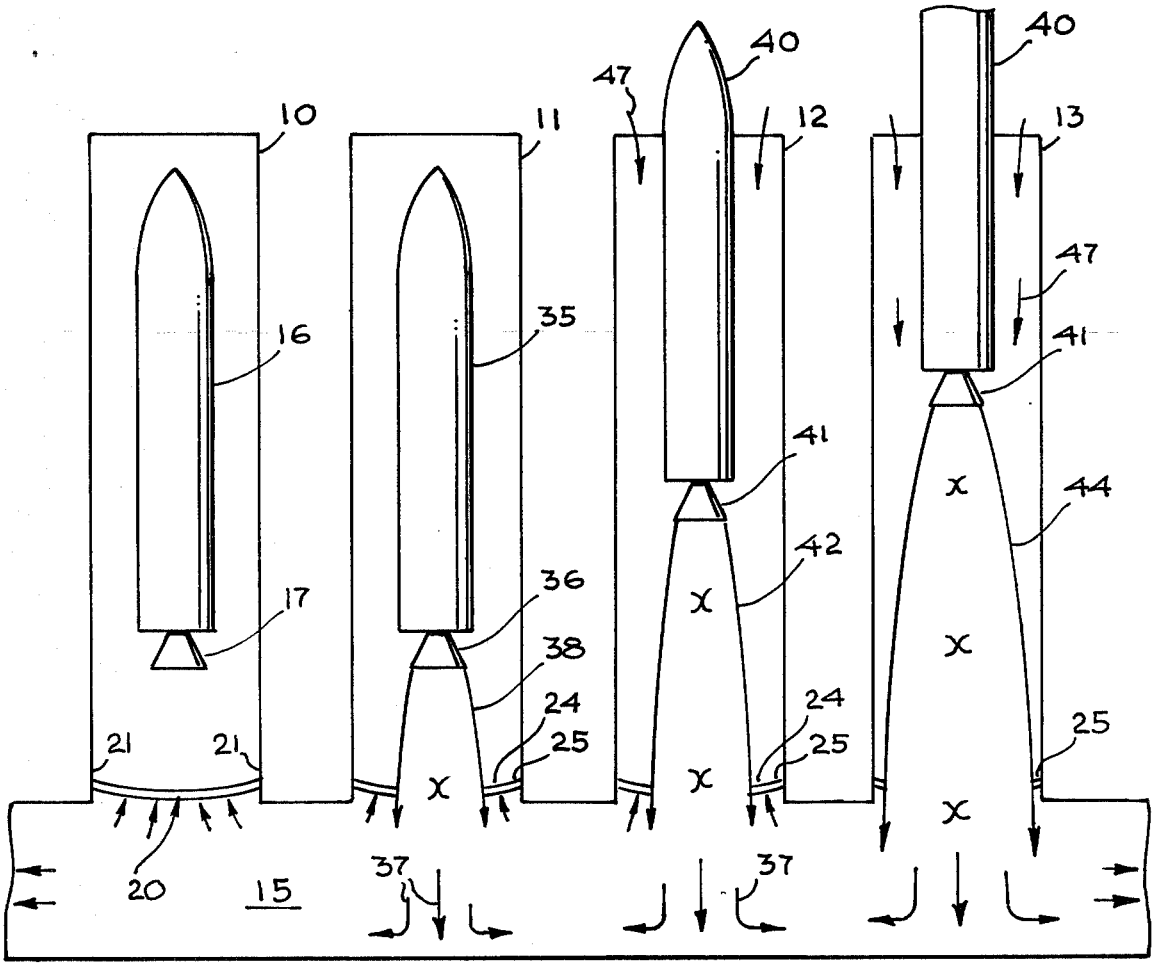
FIG. 1 is a schematic side elevational view illustrating a plurality of launch tubes having rockets therein, one showing a stored rocket, one illustrating a held-down first rocket, and the other launch tubes illustrating fired rockets in various stages of ascent.

Referring now to the drawing, and particularly to FIG. 1, there is illustrated schematically a rocket launch installation. The installation includes a plurality of launch tubes, such as 10, 11, 12 and 13. It will be understood that the number of launch tubes is arbitrary, and that more or fewer tubes may be provided.

The launch tubes are capable of being connected to a common duct or plenum chamber 15 for conducting away the exhaust gases created by the rockets launched from the launch tubes 10–13. It will, of course, be understood that instead of rockets, missiles or other exhaust-propelled vehicles may be used.

The launch tube 10 illustrates a rocket 16 disposed therein. The rocket may be held by a suitable hold-down device (not shown), such devices being well known to those skilled in the art. The rocket 16 is provided with an exhaust nozzle 17 through which the hot exhaust gases emerge.

Figure 2:
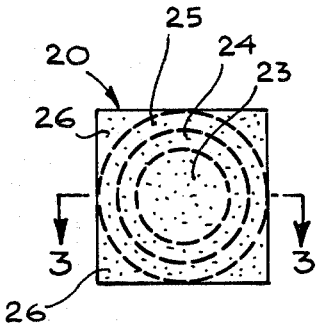
FIG. 2 is an end elevational view of the frangible cover of the present invention.
Figure 3:
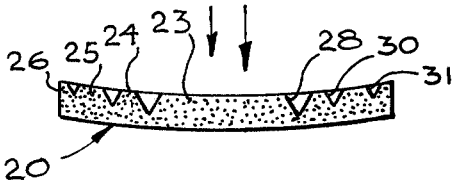
FIG. 3 is a sectional view taken on lines 3—3 of FIG. 2 and illustrating a plurality of grooves provided in the cover of the launch tubes for creating various break-away sections.

The bottom of the launch tube 10 is closed in accordance with the present invention by a frangible cover 20 shown in greater detail in FIGS. 2 and 3, to which reference is now made. The cover 20 is secured to the walls 21 of the launch tube 10 in any suitable manner, for example, by welding or by suitable fastening devices. As shown particularly in FIG. 2, the cover 20 may consist of a central, substantially circular section 23, and a plurality of surrounding substantially annular sections 24 and 25. However, it will be understood that instead of a central, circular section 23, and surrounding annular sections 24 and 25, other shapes may be used, such as a square or rectangular central section, and surrounding sections of corresponding shape. Also, only a single frangible central section may be provided. The cover 20 may also be provided with frangible corner sections 26.

The various sections 23–26 are frangible, that is, they are arranged to be broken away due to the influence of the exhaust plume or column of the space vehicle. This may, for example, be accomplished as illustrated in FIG. 3. The central section 23 is surrounded by a suitable groove 28 which may be circular in the example shown in FIG. 2. The annular sections 24 and 25 are in turn formed or separated by corresponding grooves 30 and 31. Preferably, the groove 28 which forms the central section 23 has the greatest depth so that this portion will break off first under the least pressure. The next two grooves 30 and 31 may successively have smaller depths as shown so that the surrounding sections 24 and 25 break off successively, one after the other. However, it will be understood that the sections, such as 23–25, may be arranged to break away in some other manner.

Figure 6:
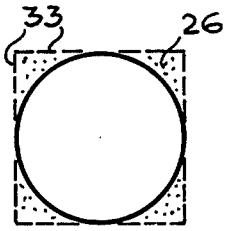

When it is desired to cause the corner sections 26 to break off, suitable grooves are provided in the rectilinear or square outlines about the corner sections 26 which are shown in dotted lines at 33 in FIG. 6. The grooves corresponding to the dotted lines 33 may be of even lesser depth than the grooves 30 and 31 so that the corner sections 26 break off last; that is, after sections 24 and 25 have broken off.

The cover 20 consists of a material capable of withstanding the heat of the exhaust gases and the pressure in the exhaust duct 15. Thus, assuming that the rocket 35 of FIG. 1, with its nozzle 36, has been accidentally fired. Because the rocket is held by a hold-down device, it will not be able to move upward in its launch tube 1. Nevertheless, the cover 20 will be broken at least at its central section 23 by the exhaust plume or column. Consequently, the exhaust gases are able to enter the plenum chamber or exhaust duct 15, and the gases flow in the direction shown by arrows 37.

The design of a typical frangible cover 20 requires consideration of the following parameters: the ballistic values of the rocket motor, which includes the pressure of a launch tube such as 10, flow rate, combustion temperature and throat diameter. In addition, consideration must be given to the cross-sectional flow area of the launch tube 10, maximum launch tube design pressuring during a normal launch, cross-sectional flow area of the manifold 15, pressure in the manifold resulting from the maximal exhaust flow rate, and a theoretical or experimental description of the rocket exhaust flow field, as a function of time, axial and radial directions. In this case the required flow elements are pitot pressure, static pressure or local ambient pressure ($P_{AMB}$), static temperature, velocity, Mach number, gas constant, and specific heat ratio.

Figure 4:
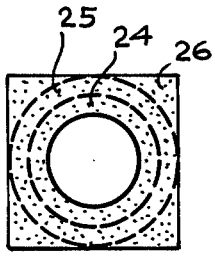
FIGS. 4, 5 and 6 are end views similar to that of FIG. 2, and showing the cover with successively larger portions of the cover being broken away by the increasing pressure and diameter of the rocket exhaust plume or column.
Figure 5:
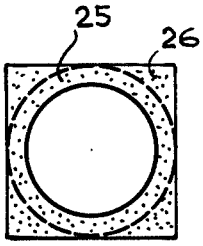

The design proceeds generally in the following manner: the location of the cover 20 and the dimensions of the frangible sections 23–26 are established by the end dimensions of the launch tube 10 and/or the launch tube flow area. If the launch tube is not circular in cross-section, a transition to rectilinear dimensions is made. Dimensions of the sections 23–26 are determined by the requirement that the opening through the cover 20 must be completely engulfed by the exhaust pitot pressure, that is at least as great as the static pressure in the manifold 15. Any particular cross section of the exhaust stream or flow field, such as 38, 42, or 44, can be substantially described as a series of concentric pressure rings. The pressure increases toward the axis of the exhaust flow 38, 42, or 44, the innermost central pressure being greater than that of the next adjacent annular ring which, in turn, is greater than that of successive outer pressure rings. The outermost pressure ring has a pressure equal to $P_{AMB}$. The static pressure in the manifold 15 is determined in a conventional and well-known manner from the mass flow rate and static properties of the exhaust and from the manifold cross-sectional area. The pressure inside a particular opening of the cover 20, as shown in FIGS. 4–6 under a particular firing condition, must be at least as great as the manifold static pressure to prevent gases in the manifold from flowing back up into the launch tube, such as 10.

If the rocket motor ballistics vary with time, so does the exhaust pressure field, and so does the pressure in the manifold 15 for a fixed manifold cross-sectional flow area. The initial design is based on the maximum expected rocket flow rate and ballistics. It is checked at lesser flow rates to assure that the manifold pressure does not exceed the exhaust pitot pressure at the new equilibrium opening in the cover 20. If it does, then to prevent back flow, dimensions of the opening must be made smaller so that a higher exhaust pitot pressure will result at the bottom opening of the cover 20.

Depending on the size of the exhaust plume 38, that is, depending on its diameter, more or fewer of the frangible sections 23, 24 and 25 or 26 will break away. For example, FIG. 4 illustrates that the central section 23 has broken away leaving sections 24 and 25, as well as the corner sections 26.

Thus the cover 20 of one launch tube should be strong enough to withstand the heat and pressure in the exhaust duct 15 when one of the rockets in another launch tube is accidentally or on purpose ignited.

Considering now the case where a rocket is fired on purpose, such as the rocket 40 with its exhaust nozzle 41 in the launch tube 12. As the rocket moves out of the launch tube, its exhaust plume 42 will increase in size being of a relatively small diameter 42 in the launch tube 12. Considering the same rocket 40 in the launch tube 13 which has moved out a substantial distance, now the rocket plume 44 is of larger diameter, as clearly shown. Hence, successive sections of the cover 20 will be broken away, such as sections 23, 24 and 25 or 26. The sections will break away due to the increasing diameter of the rocket plume which in turn means increased pressure on an increasingly larger area of the cover 20. This results in an increasingly larger opening between the respective launch tube, 12 or 13, and the exhaust duct 15. The result of this is that there is substantially no increase in pressure in the launch tube. Eventually, as shown by arrows 47 in the launch tubes 12 and 13, ambient air is entrained into the exhaust flow in the launch tubes and mixes with the exhaust gases. A further result of the progressively wider openings of the cover 20 is that all the exhaust gases flow in one direction only, that is, downwardly, as shown by the arrows 37, and then flow into the exhaust duct 15. Thus, an effective area flow control is established.

What has been described so far in connection with FIGS. 1–5 is a rocket having an exhaust plume 42 or 44 of substantially circular cross section. If, for example, the launcher is is the form of a canister, it is also feasible that the corners 26 of the cover 20 as shown in FIG. 6 are made frangible as explained hereinabove and are capable of breaking out. Therefore, they will provide a substantially square or rectangular opening for the flow of the exhaust gases.

The frangible rear cover for a launch tube of the present invention has certain advantages. It is of much simpler construction and hence less expensive than some prior art devices utilizing doors. The hinge mechanism of the doors may be subject to corrosion or the like by the corrosive rocket gases or the high temperatures thereof. It provides a different option to obtain the same result. On the other hand, once the frangible cover has been broken, the respective launch tube remains open. This may be useful where only aspiration is desired. Where protection against accidental launching is desired, it may be convenient to add a normally open door in the launch tube which closes in response to the firing of the rocket, as disclosed in the applicant's copending application.

There has thus been disclosed apparatus for normally closing one end of a launch tube for rockets and the like, and for opening the rear end of a launch tube in response to the exhaust plume of the vehicle. This is accomplished by the provision of a frangible cover at the rear end of the launch tube. The cover has a frangible section or sections, which break away under the pressure of the exhaust plume. As the exhaust plume increases in diameter, successive sections of the frangible cover break away due to the increased pressure acting thereon. The frangible cover provided in accordance with the present invention for closing the rear end of the launch tube is simple in construction and reliable in operation. It will provide a connection between the launch tube and an exhaust duct or plenum with an increasing opening in response to an increase of the diameter of the plume. This in turn will prevent any increase of the pressure in the launch tube.

Although there have been described above specific arrangements of a multiple area rear launch tube cover in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. Apparatus for normally closing one end of a launch tube for exhaust-propelled vehicles and for opening the end of the launch tube in response to the exhaust plume of the vehicle, said apparatus comprising:

a launch tube;

a duct disposed adjacent said launch tube for conducting away the exhaust of the vehicle; and a cover for normally blocking connection between said launch tube and said duct, said cover having at least one frangible central section capable of breaking in response to the pressure of the exhaust plume of the vehicle, thereby to establish connection between said launch tube and said duct.

2. Apparatus as defined in claim 1 wherein said cover includes a plurality of sections surrounding said central section, and further including means for causing breakage of said central and said surrounding sections successively in response to the exhaust plume increasing in diameter, thereby to create an exit for the exhaust gases sufficient to provide uninhibited access of the gases to said duct.

3. Apparatus as defined in claim 2 wherein said central section is substantially circular and said surrounding sections are substantially annular and concentric with said central sections.

4. Apparatus as defined in claim 3 wherein corner sections are provided surrounding the outermost surrounding section to provide a substantially rectilinear outline, and wherein grooves are provided to define said corner sections and to cause them to break away in response to a further increase in diameter of the exhaust plume.

5. Apparatus as defined in claim 2 wherein said cover consists of a single piece of heat-resistant material having grooves between said sections of a depth sufficient to cause said sections to break away successively in response to the increase in diameter of the exhaust plume.

6. Apparatus as defined in claim 5 wherein the groove surrounding said central section is deeper than the grooves between said surrounding sections.

7. Apparatus as defined in claim 5 wherein the groove surrounding said central section is the deepest groove, while the grooves between successive surrounding sections adjacent to said central section and the outer sections are of increasingly smaller depth so that said central section will first break off while successive surrounding sections will break off one after the other.

8. Apparatus for normally closing one end of a launch tube for exhaust propelled vehicles and for opening the end of the launch tube in response to the exhaust plume of the vehicle, said apparatus comprising:

a launch tube;

a plenum chamber disposed adjacent said launch tube for conducting away the exhaust of the vehicle;

a cover for normally closing the connection between said launch tube and said plenum chamber, said cover being of rectilinear shape and having a substantially circular central section and a plurality of substantially annular surrounding sections, and corner sections between the outer edge of said cover and the outermost annular section; and a plurality of grooves between said central section, said annular surrounding sections and said corner sections, said grooves having a depth which is increasingly smaller from said central section outward between said annular surrounding sections and said corner sections, whereby said sections are capable of breaking successively in response to an expanding pressure of the exhaust plume of the vehicle.

* * * * *